US006646610B2

(12) United States Patent
Troelsen

(10) Patent No.: US 6,646,610 B2
(45) Date of Patent: Nov. 11, 2003

(54) ANTENNA

(75) Inventor: Jens Troelsen, Copenhagen (DK)

(73) Assignee: Nokia Corporation, Espoo (FI)

( * ) Notice: Subject to any disclaimer, the term of this patent is extended or adjusted under 35 U.S.C. 154(b) by 0 days.

(21) Appl. No.: 10/024,527

(22) Filed: Dec. 21, 2001

(65) Prior Publication Data

US 2003/0137458 A1 Jul. 24, 2003

(51) Int. Cl.[7] ..... H01Q 1/24
(52) U.S. Cl. ..... 343/702; 343/700 MS
(58) Field of Search ..... 343/702, 700 MS, 343/841, 846; 455/90

(56) References Cited

U.S. PATENT DOCUMENTS 5,764,190 A * 6/1998 Murch et al. ..... 343/702
2001/0021643 A1 * 9/2001 Itoh ..... 455/90

* cited by examiner

*Primary Examiner*—Hoang Nguyen
(74) *Attorney, Agent, or Firm*—Antonelli, Terry, Stout & Kraus, LLP

(57) ABSTRACT

An communication terminal for radio communication has an antenna including a PIFA structure being provided with a ground plane element, at least one radiating element, and feeding means for connecting a signal path from a transceiver of the terminal to said at least one radiating element. The antenna comprises a conducting plate element arranged to be substantially in parallel with said PIFA structure. The conducting plate element is electrically floating in relation to said at least one radiating element.

23 Claims, 5 Drawing Sheets

Fig. 13
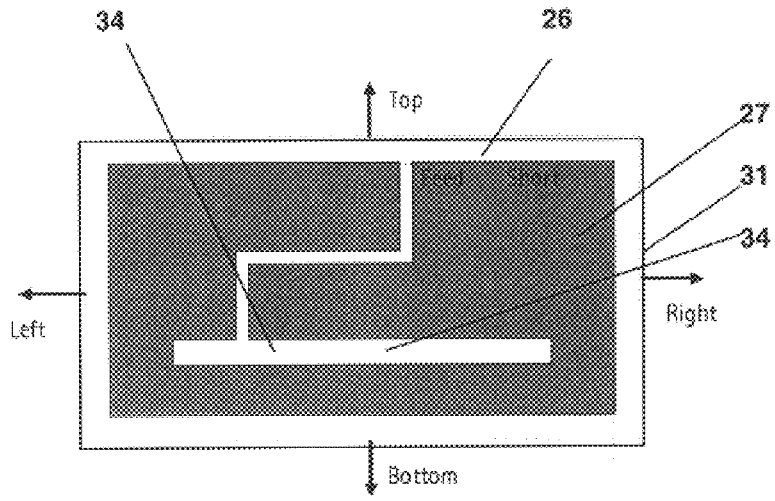
Fig. 14
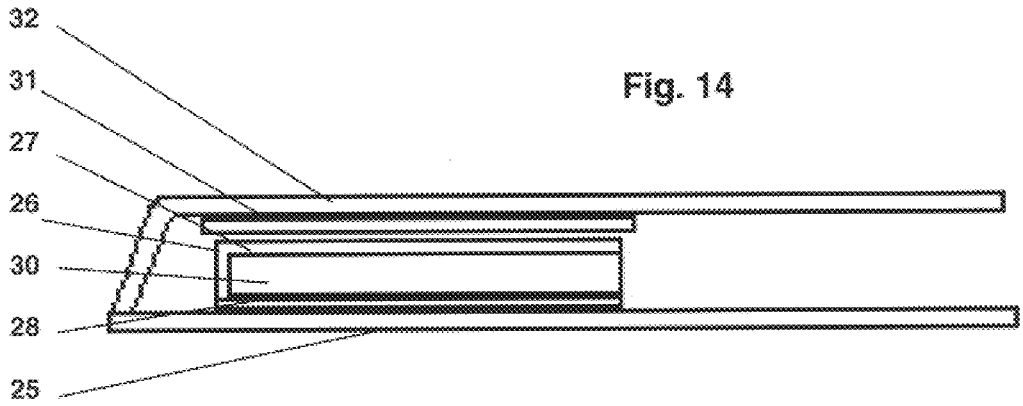
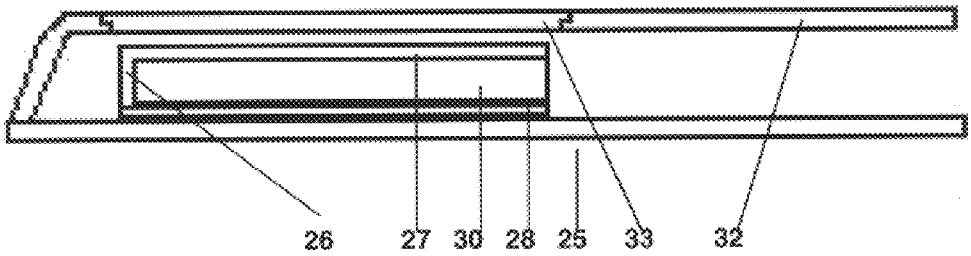
Fig. 15

ANTENNA

BACKGROUND OF THE INVENTION

The invention relates to an antenna design improving the immunity of the antenna against detuning due to the users way of holding a terminal in which the antenna is implemented.

With the introduction of internal antennas in cellular phones, problems concerning detuning the antennas during talk have arised. This is due to the fact that the fingers of the user partly cover the antenna due to an inappropiate way of holding the phone. It has been tried to overcome these problems by designing the phone housing is a way so the user is invited to hold his fingers in an appropriate way.

SUMMARY OF THE INVENTION

An object of the invention is to provide an antenna including a PIFA structure having a ground plane element, at least one radiating element, and feeding means for connecting an RF connection to said at least one radiating element. The antenna furthermore comprises a conducting plate element arranged to be substantially in parallel with said PIFA structure, and said conducting plate element is electrically floating in relation to said at least one radiating element. The floating plate covers provides a shield for the antenna against the users fingers.

The conducting plate element is placed very close to the radiating element compared with the distance between the ground plane element and said at least one radiating element. The ratio of distance between the ground plane element and said at least one radiating element, and the distance between the conducting plate element and said at least one radiating element is preferably within the range two to eight—approximately four.

The size of the conducting plate element is substantially the same as the size of said at least one radiating element, and it exceeds the edges of said at least one radiating element—at least along edge carrying significant edge currents. According to the preferred embodiment the edges of the conducting plate element exceeds the edges of said at least one radiating element along its entire periphery.

According to a second aspect of the invention there is provided a communication terminal for radio communication having an antenna, and including a PIFA structure being provided with a ground plane element, at least one radiating element, and feeding means for connecting a signal path from a transceiver of the terminal to said at least one radiating element. The antenna furthermore comprises a conducting plate element arranged to be substantially in parallel with said PIFA structure, and said conducting plate element is electrically floating in relation to said at least one radiating element. The floating plate protects the antenna from detuning when the user places his fingers close to the PIFA structure.

According to the preferred embodiment of the invention, the ground plane element is provided on a printed circuit board of the terminal, e.g. as a lid of shielding cans containing electric components, and said at least one radiating element is mounted on a dielectric body being mounted onto printed circuit board. The ground plane element and said at least one radiating element may be separated by an air gab. Preferably, the conducting plate element is mounted on a housing wall of the terminal as a metallic layer coated onto the inner housing wall. According to an alternative embodiment of the floating plate is constituted by a metal wall electrically floating in relation to the rest of the terminal.

According to a third aspect of the invention there is provided a method of reducing the detuning sensitivity of an antenna, including a PIFA structure being provided with a ground plane element, at least one radiating element, and feeding means for connecting a signal path from a transceiver of the terminal to said at least one radiating element. The method comprises placing a conducting plate element substantially in parallel with said PIFA structure, and allowing said conducting plate element to be electrically floating in relation to said at least one radiating element.

BRIEF DESCRIPTION OF THE DRAWINGS

For a better understanding of the present invention and to understand how the same may be brought into effect reference will now be made, by way of example only, to accompanying drawings, in which:

FIG. 13 shows the design of the antenna element and the floating plate according to the preferred embodiment of the antenna.

FIG. 14 shows in cross section a preferred embodiment of a communication terminal for radio communication and having an antenna including a PIFA structure and a floating plate provided as a foil attached to a housing part of the terminal.

FIG. 15 shows in cross section a further embodiment of a communication terminal for radio communication and having an antenna including a PIFA structure and a floating plate provided as a part of the housing of the terminal.

DETAILED DESCRIPTION OF THE INVENTION

Figures 1A, 1B:
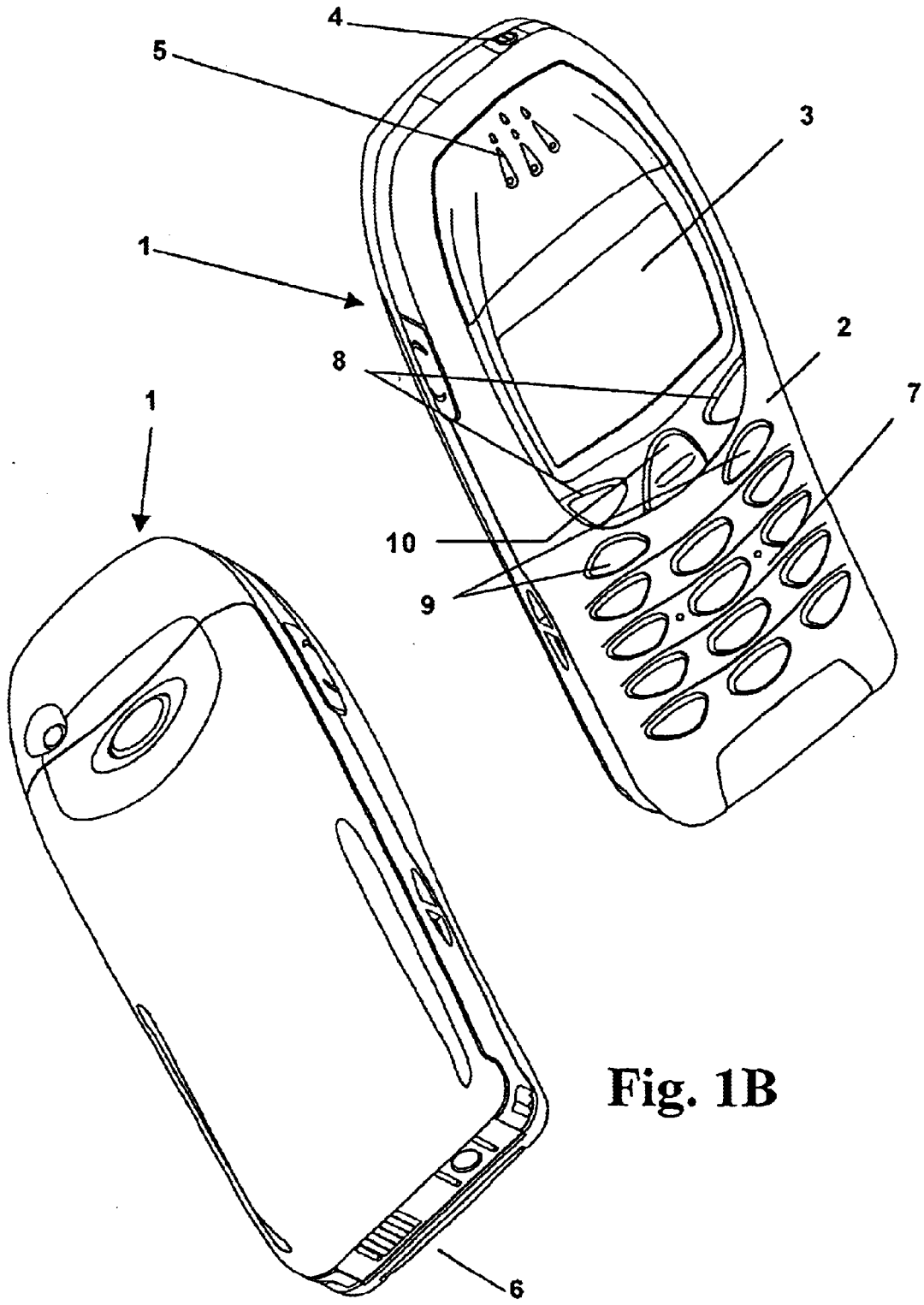
FIG. 1 schematically illustrates a preferred embodiment of a hand portable phone according to the invention.

FIG. 1 shows a preferred embodiment of a terminal according to the invention, such as a cellular phone, which comprises a user interface having a keypad 2, a display 3, an on/off button 4, a speaker 5 (only openings are shown), and a microphone 6 (only openings are shown). The phone 1 according to the preferred embodiment is adapted for communication preferable via a cellular network, e.g. a GSM network.

According to the preferred embodiment the keypad 2 has a first group 7 of keys as alphanumeric keys, two soft-keys 8, and a navigation key 10 for moving a cursor. Furthermore the keypad includes two call-handling keys 9 for initiating and terminating calls. The present functionality of the soft-keys 8 is shown in a separate field in the bottom of the display 3 just above the soft-keys 8. This key layout is characteristic of e.g. the phone launched by the applicant under the trade name Nokia 6210™.

Figure 2:
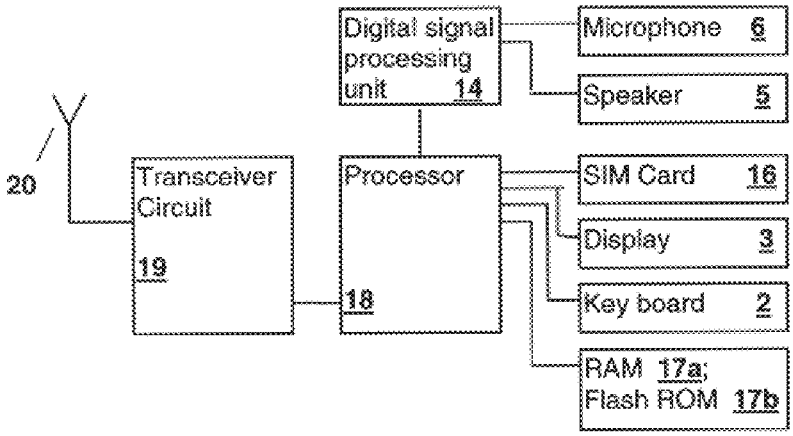
FIG. 2 schematically shows the essential parts of a telephone for communication with e.g. a cellular network.

FIG. 2 schematically shows the most important parts of a preferred embodiment of the phone, said parts being essential to the understanding of the invention. A processor 18, which supports the GSM terminal software, also controls the communication with the network via the transmitter/receiver circuit 19 and an antenna 20.

The microphone 6 transforms the user's speech into analogue signals; the signals formed thereby are A/D converted in an A/D converter (not shown) before the speech is encoded in an audio part 14. The encoded speech signal is transferred to the processor 18. The processor 18 also forms the interface to a RAM memory 17*a* and a Flash ROM memory 17*b*, a SIM card 16, the display 3 and the keypad 2 (as well as data, power supply, etc.). The audio part 14 speech-decodes the signal, which is transferred from the processor 18 to the earpiece 5 via a D/A converter (not shown).

Figure 3:
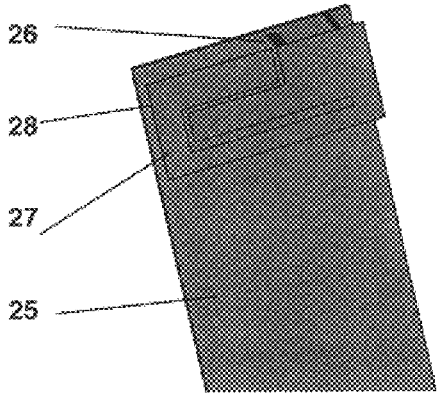
FIG. 3 shows a dual band antenna structure according to prior art.
Figure 4:
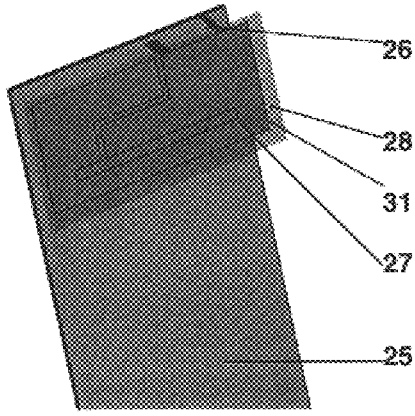
FIG. 4 shows a preferred embodiment of a dual band antenna structure with a floating plate member according to the invention.

In the following the electric field distributions surrounding an ordinary dual band PIFA (Planar Inverted F-Antenna), shown in FIG. 3, and a floating plate solution according to the invention is shown in FIG. 4 will be discussed. Both these designs are investigated by using a computer-based simulation tool from CST, and being able to analyse accurate 3D EM design solutions. The size and shape of the simulated PIFA structure shown in FIG. 3 is similar to the antenna used in Nokia 8310.

An antenna element 27 is mounted on a dielectric body 30 having the dimensions: Width=40 mm, Height=20 mm, and Depth=8 mm. Both antennas are designed as dual band antennas for GSM 900 and GSM 1800. A PCB 25 is 105 mm long. The dielectric body 30 is mounted on the PCB 25 and an antenna feed 26 being integrated with the antenna element 27 connects a signal path and ground from a transceiver of the terminal to said antenna element 27. The antenna element 27 constitutes at least one radiating element, but in many cases the antenna element 27 supports multiple frequency bands. A floating plate 31 is located 2 mm above the antenna element 27 of the PIFA structure. The floating plate 31 has a 44 mm width and 24 mm height. Width=40 mm, Height=20 mm. It should be noted that the patch geometries of the two solutions are different. However the locations of the feeds and shorts are identical.

The bandwidths of the two antennas of FIG. 3 and FIG. 4 are more or less identical to the bandwidths of Nokia 8310.

Figure 5:
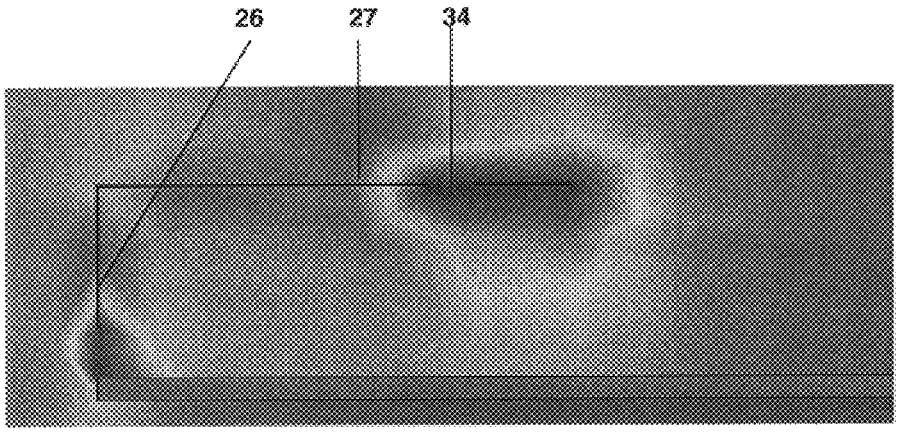
FIG. 5 shows in side view the amplitude of the total electric field at 900 MHz for the dual band antenna shown in FIG. 3.
Figure 7:
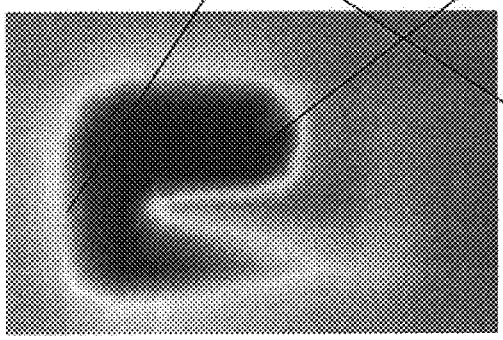
FIG. 7 shows from the rear side of the phone the amplitude of the total electric field at 900 MHz for the dual band antenna shown in FIG. 3.
Figure 9:
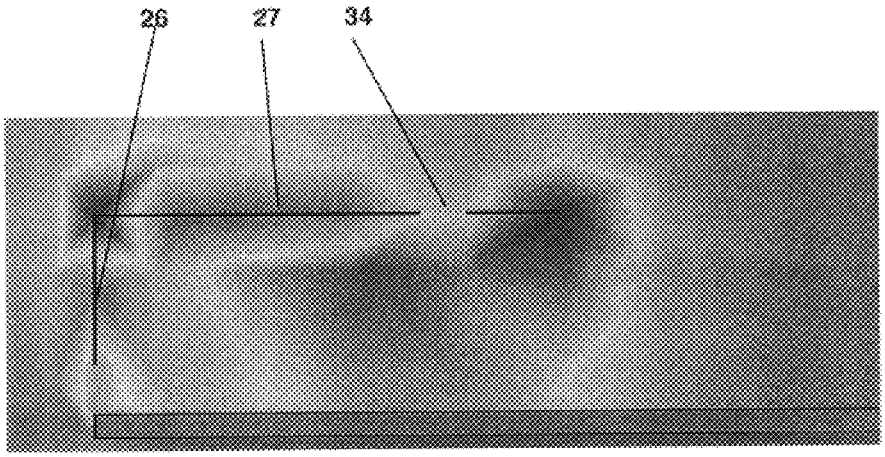
FIG. 9 shows in side view the amplitude of the total electric field at 1800 MHz for the dual band antenna shown in FIG. 3.
Figure 11:
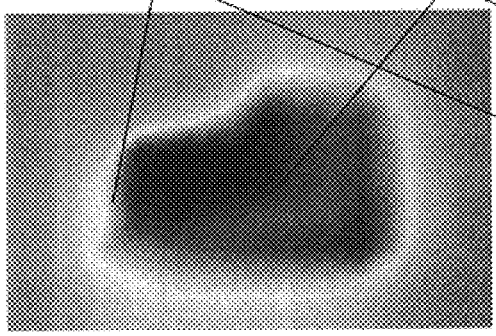
FIG. 11 shows from the rear side of the phone the amplitude of the total electric field at 1800 MHz for the dual band antenna shown in FIG. 3.

FIG. 7 shows (seen from the rear side of the phone) the amplitude of the total electric field at 900 MHz 3 mm above the antenna elements 27 (the PIFA patches) for the dual band antenna in FIG. 3. FIG. 11 shows the amplitude of the total electric field at 1800 MHz for the dual band antenna in FIG. 3. FIG. 5 and FIG. 9 shows (in side view of the phone—in the plane penetrating the feed line) the amplitude of the total electric field at 900 MHz, and at 1800 MHz, respectively.

Figure 6:
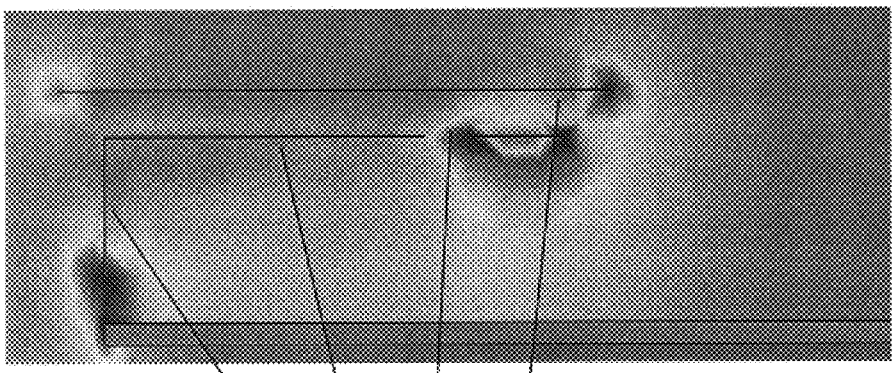
FIG. 6 shows in side view the amplitude of the total electric field at 900 MHz for the dual band antenna with a floating plate member as shown in FIG. 4.
Figure 8:
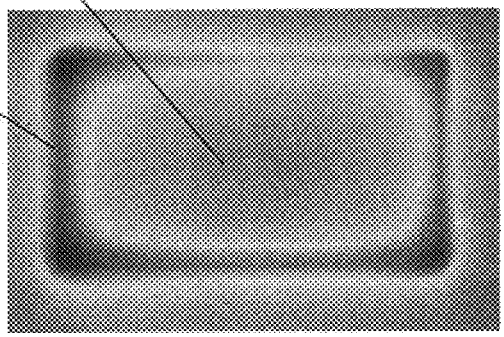
FIG. 8 shows from the rear side of the phone the amplitude of the total electric field at 900 MHz for the dual band antenna with a floating plate member as shown in FIG. 4.
Figure 10:
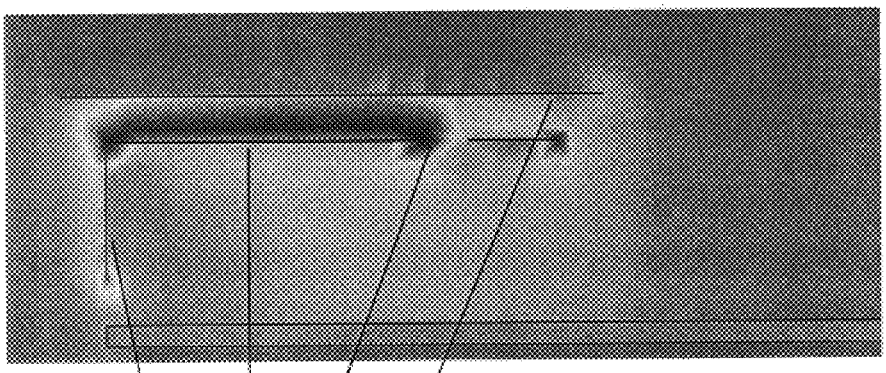
FIG. 10 shows in side view the amplitude of the total electric field at 1800 MHz for the dual band antenna with a floating plate member as shown in FIG. 4.
Figure 12:
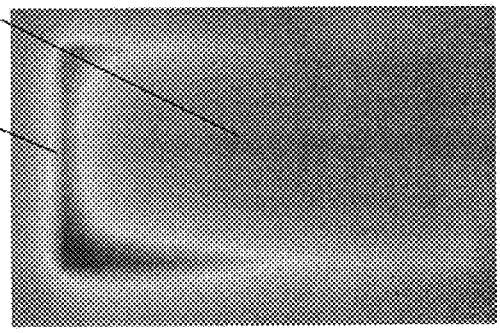
FIG. 12 shows from the rear side of the phone the amplitude of the total electric field at 1800 MHz for the dual band antenna with a floating plate member as shown in FIG. 4.

FIG. 8 shows (seen from the rear side of the phone) the amplitude of the total electric field at 900 MHz 3 mm above the antenna elements 27 (the PIFA patches) for the dual band antenna with a floating plate member as shown in FIG. 4. The distance between the floating plate 31 and the antenna elements 27 is here two mm. FIG. 12 shows the amplitude of the total electric field at 1800 MHz for the dual band antenna with a floating plate member as shown in FIG. 4. FIG. 6 and FIG. 10 shows (in side view of the phone—in the plane penetrating the feed line) the amplitude of the total electric field at 900 MHz, and at 1800 MHz, respectively.

By comparing the different views, it is seen that the floating plate provides a "shielding" effect for the antenna. Second, it may be observed that the floating plate covers or shields more at 1800 MHz than 900 MHz. It should also be noted that the field, especially at 1800 MHz has high amplitude between the PIFA and the plate, see FIG. 10.

Several talk position configurations has been investigated using the antenna structures shown in FIGS. 3 and 4. Statistical normal distributions were obtained to understand the detuning introduced by the hand. It was found that the 900 MHz resonance (of the tx tuned phone) in average was reduced from 897 MHz to 822 MHz. The higher resonance was in average reduced from 1745 MHz to 1681 MHz. These observations indicate that a suitable tuning scheme must be able to change the resonance frequency app. 80–100 MHz. A proper tuning in talk positions increase performance 2–4 dB.

According to the invention talk position performance is improved by using an antenna design with relative low coupling to the hand. A perfect electrical conductor 31 (e.g. a copper plate) is placed in front of a dual band PIFA suitable for GSM applications. The new near field distributions introduced by the plate reduce the coupling to the hand of the user. In other words the plate acts as a shield placed between the PIFA and the hand of the user.

Below the geometry's of the antennas are described and the near field distributions are explained. Next, the dimensions of the plate and the distance between the PIFA and plate are analysed. Finally, the tolerances are discussed.

FIG. 13 illustrates the four directions the plate 31 was extended. The dimensions of the antenna and plate are described with reference to FIG. 4. It is seen that the electrically floating plate 31 fully covers the antenna element 27 and extends beyond the edges of this element 27. The antenna element 27 is provided with a slit 34 extending from the feed 26 in order to tune the resonance frequencies of the antenna element 27 to the bands for which the antenna is used.

Table 1 shows the impact on the resonance frequencies and the bandwidth of the antenna. The plate is extended as illustrated by FIG. 13. For each plate side an extension between 0 to 6 mm was analysed.

A top extension (in the feeding end of the antenna) increases the bandwidth at both bands and reduces the resonance frequency at the 900 MHz band. A bottom extension reduces resonance frequencies for both frequency bands. The bandwidth at 1800 MHz will be reduced. An extension on the left side reduces the resonance frequencies for both frequency bands. An extension on the right side reduces the resonance frequency at the 900 MHz band.

It was observed that no "pure" half wave resonance is excited on the plate. The presence of the plate introduces a resonance frequency at 3635 MHz. The location of this resonance frequency is not affected by the extensions of Table 1.

TABLE 1

The table indicates the impact on the resonance frequencies and the bandwidth. All the numbers corresponds to 6 mm extensions.

| | Res 900 | BW 900 | Res 1800 | BW 1800 | Res Plate |
|---|---|---|---|---|---|
| Top extension | ⇓20 MHz | ⇑5 MHz | Const | ⇑25 MHz | Const |
| Bottom extension | ⇓30 MHz | Const | ⇓50 MHz | ⇓30 MHz | Const |
| Left extension | ⇓20 MHz | ⇑5 MHz | ⇓50 MHz | Const | Const |
| Right extension | ⇓15 MHz | Const | Const | Const | Const |

The thickness of plate 31 must be sufficient to ensure that the waves do not penetrate the plate. If copper is used the penetration depth is $\delta=2\ \mu m$ at 1 GHz and $\delta=1.5\ \mu m$ at 2 GHz. Hence, copper thickness in the range of 20–30$\mu$m is sufficient.

The Distance Between the PIFA and the Plate

The distance between the PIFA and the plate has been investigated. Changing the distance from 1 mm to 3 mm does not change the match at the GSM bands significantly. Table 2 illustrates the impact on the relative 6 dB bandwidth. Reducing the distance improves the bandwidth at 900 MHz. On the other hand the bandwidth at 1800 MHz is decreased. Free space distances between 2 and 3 mm seem preferable for this combination of frequencies.

TABLE 2

The table illustrates the relative bandwidth as a function of the distance between the PIFA and the floating plate.

| Plate-PIFA distance | Relative BW 900 | Relative BW 1800 |
|---|---|---|
| 1 mm | 15.6% | 8.2% |
| 2 mm | 13.6% | 8.9% |
| 3 mm | 12.0% | 9.8% |

Tolerances

Simulations and measurements were performed to investigate the tolerances of the plate location and dimensions. It was found that the distance between the plate and PIFA is the most critical parameter. The simulation results are shown in table 3. The table indicates that a 0.1 mm production accuracy is desirable.

TABLE 3

The table illustrates the change in resonance frequency caused by a certain change in the distance between the plate and the PIFA patch.

| Δ Plate-PWA Distance | Δ Resonance 900 | Δ Resonance 1800 |
|---|---|---|
| 0.1 mm | 3 MHz | 6 MHz |
| 0.2 mm | 6 MHz | 12 MHz |

At 900 MHz the presence of the plate increase the Bandwidth. Reducing the distance between the PIFA and the plate improves the bandwidth, see table 2. Furthermore, a plate extension decreases the resonance frequency without decreasing the bandwidth, see table 1. In conclusion, the floating plate works well at 900 MHz.

At 1800 MHz the situation is unclear. Reducing the distance between the PIFA and the plate decreases the bandwidth, see table 2. For the specific configuration investigated in this chapter the bandwidth is improved by extending the plate to the left or at the top, see table 1.

FIG. 14 shows in cross section a communication terminal for radio communication and having an antenna including a PIFA structure being provided with metallic layer 28 provided as a ground plane element placed on the PCB. The antenna element 27 provides at least one radiating element, and the feed 26 provides a signal path from a transceiver (not shown) of the terminal to the antenna element 27. The antenna furthermore comprises a conducting plate element acting as the floating plate 31, and being mounted as a foil on a housing wall 32 of the terminal. The antenna element 27 may be mounted on the inner side of a plastic box, whereby the dielectric material may be air. Otherwise the dielectric material may be an appropriate dielectric. The thickness of plate 31 must be sufficient to ensure that the waves do not penetrate the plate 31. Copper foil may be used. The housing wall 32 ensures the mechanical stability.

FIG. 15 shows in cross section an alternative embodiment of the communication terminal according to the invention. Instead of mounting the floating plate 31 as a foil on a housing wall 32, the floating plate may be provided as a metallic window 33 inserted in the housing wall. The metallic window 33 must have a thickness of approximately 0.5–0.8 mm to ensure the mechanical stability of the housing.

Suitable free space distances between the PIFA and the plate are 2–3 mm. For these distances acceptable bandwidths at 900 MHz and 1800 MHz are obtained.

The thickness of plate must be large enough to ensure that the waves do not penetrate the plate. Plate thickness in the range of 20–30 $\mu$m is sufficient if copper is used.

The tolerances of the plate dimensions and the plate location were investigated. It was found that the distance between the PIFA and the plate is the most critical parameter. A 0.1 mm production accuracy is desirable.

The floating plate solution improves the efficiency in all the tested talk position configurations. The improvement is between 1 dB and 5 dB.

What is claimed is:

1. An antenna including a PIFA structure comprising:

a ground plane element, at least one radiating element, and feeding means for connecting an RF connection to said at least one radiating element, wherein said antenna furthermore comprises a conducting plate element arranged to be substantially in parallel with said PIFA structure, and said conducting plate element is electrically floating in relation to said at least one radiating element, the conducting plate element being provided along the PIFA structure adjacent to said at least one radiating element, the distance between the conducting plate element and said at least one radiating element being smaller than the distance between the ground plane element and said at least one radiating element.

2. An antenna according to claim 1, wherein the ratio of distance between the ground plane element and said at least one radiating element, and the distance between the conducting plate element and said at least one radiating element within the range two to eight.

3. An antenna according to claim 2, wherein the ratio of distance between the ground plane element and said at least one radiating element, and the distance between the conducting plate element and said at least one radiating element is approximately four.

4. An antenna according to claim 1, wherein the ratio of distance between the ground plane element and said at least one radiating element, and the distance between the conducting plate element and said at least one radiating element is approximately four.

5. An antenna according to claim 1, wherein the size of the conducting plate element is substantial the same as the size of said at least one radiating element.

6. An antenna according to claim 5, wherein the conducting plate element exceeds the edges of said at least one radiating element—at least along edge carrying significant edge currents.

7. An antenna according to claim 6, wherein the edges of the conducting plate element exceeds the edges of said at least one radiating element along its entire periphery.

8. An antenna according to claim 5, wherein the edges of the conducting plate element exceeds the edges of said at least one radiating element along its entire periphery.

9. An communication terminal for radio communication and having an antenna, and including a PIFA structure comprising:

a ground plane element, at least one radiating element, and feeding means for connecting a signal path from a transceiver of the terminal to said at least one radiating element, wherein said antenna furthermore comprises a conducting plate element arranged to be substantially in parallel with said RIFA structure, and said conducting plate element is electrically floating in relation to said at least one radiating element, the conducting plate element of the antenna being provided along the PIFA structure adjacent to said at least one radiating element, the distance between the conducting plate element and said at least one radiating element being smaller than the distance between the ground plane element and said at least one radiating element.

10. An communication terminal according to claim 9, wherein the ratio of distance between the ground plane element and said at least one radiating element, and the distance between the conducting plate element and said at least one radiating element within the range two to eight.

11. An communication terminal according to claim 10, wherein the ratio of distance between the ground plane element and said at least one radiating element, and the distance between the conducting plate element and said at least one radiating element is approximately four.

12. An communication terminal according to claim 9, wherein the ratio of distance between the ground plane element and said at least one radiating element, and the distance between the conducting plate element and said at least one radiating element is approximately four.

13. A communication terminal according to claim 9, wherein the size of the conducting plate element is substantial the same as the size of said at least one radiating element.

14. A communication terminal according to claim 13, wherein the conducting plate element exceeds the edges of said at least one radiating element—at least along edge carrying significant edge currents.

15. A communication terminal according to claim 13, wherein the edges of the conducting plate element exceeds the edges of said at least one radiating element along its entire periphery.

16. A communication terminal according to claim 13, wherein the edges of the conducting plate element exceeds the edges of said at least one radiating element along its entire periphery.

17. An communication terminal according to claim 9, wherein the ground plane element is provided on a printed circuit board of the terminal, and said at least one radiating element is mounted on a dielectric body being mounted onto printed circuit board.

18. A communication terminal according to claim 17, wherein the ground planes element and said at least one radiating element is separated by air gab.

19. A communication terminal according to claim 18, wherein the conducting plate element is mounted on a housing wall of the terminal.

20. A communication terminal according to claim 18, wherein the conducting plate element is constituted by a metallic housing wall of the terminal.

21. A communication terminal according to claim 17, wherein the conducting plate element is mounted on a housing wall of the terminal.

22. A communication terminal according to claim 17, wherein the conducting plate element is constituted by a metallic housing wall of the terminal.

23. A method of reducing the detaining sensitivity of an antenna, including a PIFA structure being provided with a ground plane element, at least one radiating element, and feeding means for connecting a signal path from a transceiver of the terminal to said at least one radiating element, comprising:

placing a conducting plate element substantially in parallel with said PIFA structure; and allowing said conducting plate element to be electrically floating in relation to said at least one radiating element, wherein the conducting plate element is provided along the PIFA structure adjacent to said at least one radiating element, the distance between the conducting plate element and said at least one radiating element being smaller than the distance between the ground plane element and said at least one radiating element.

* * * * *